United States Patent [19]

Warner

[11] 4,334,918

[45] Jun. 15, 1982

[54] METHOD OF RECOVERING NON-FERROUS METALS FROM THEIR SULPHIDE ORES

[75] Inventor: Noel A. Warner, Birmingham, England

[73] Assignee: 501 National Research Development Corp., London, England

[21] Appl. No.: 128,719

[22] Filed: Mar. 10, 1980

[30] Foreign Application Priority Data

Mar. 9, 1979 [GB] United Kingdom ..... 7908314

[51] Int. Cl.[3] ..... C22B 9/00

[52] U.S. Cl. ..... 75/21; 75/23; 75/63; 75/65 R; 75/86; 75/87; 75/88

[58] Field of Search ..... 75/21, 88, 63, 65, 23, 75/86, 87

[56] References Cited

U.S. PATENT DOCUMENTS

| | | | |
|---|---|---|---|
| 3,375,101 | 3/1968 | Mulcihy | 75/88 |
| 3,463,630 | 8/1969 | Todd | 75/23 |
| 3,892,560 | 7/1975 | Nermes | 75/23 |

FOREIGN PATENT DOCUMENTS

| | | | |
|---|---|---|---|
| 1123959 | 8/1968 | United Kingdom | 75/23 |

*Primary Examiner*—P. D. Rosenberg
*Attorney, Agent, or Firm*—Ladas & Parry

[57] ABSTRACT

A method of recovering non-ferrous metals from their ores comprises introducing the ore into a molten sulphide carrier that is forcibly circulated through an extraction circuit, contacting the molten carrier containing the dissolved or melted ore with oxygen to oxidize at least part of the ore or carrier, recovering heat thereby generated by the molten carrier, and transmitting the heat by means of the carrier to endothermic sites in the circuit.

9 Claims, 5 Drawing Figures

Figure 3:
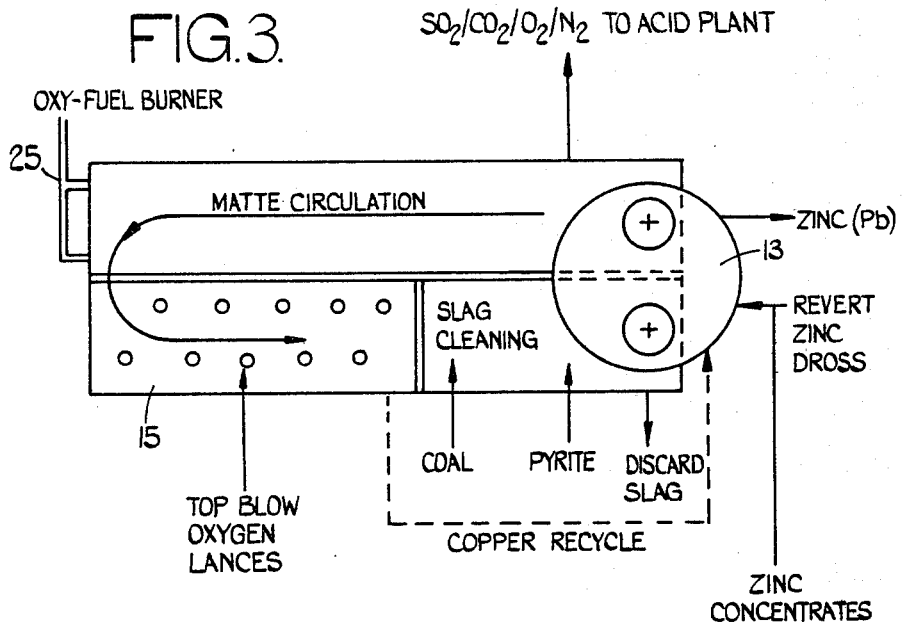

FIG.1.
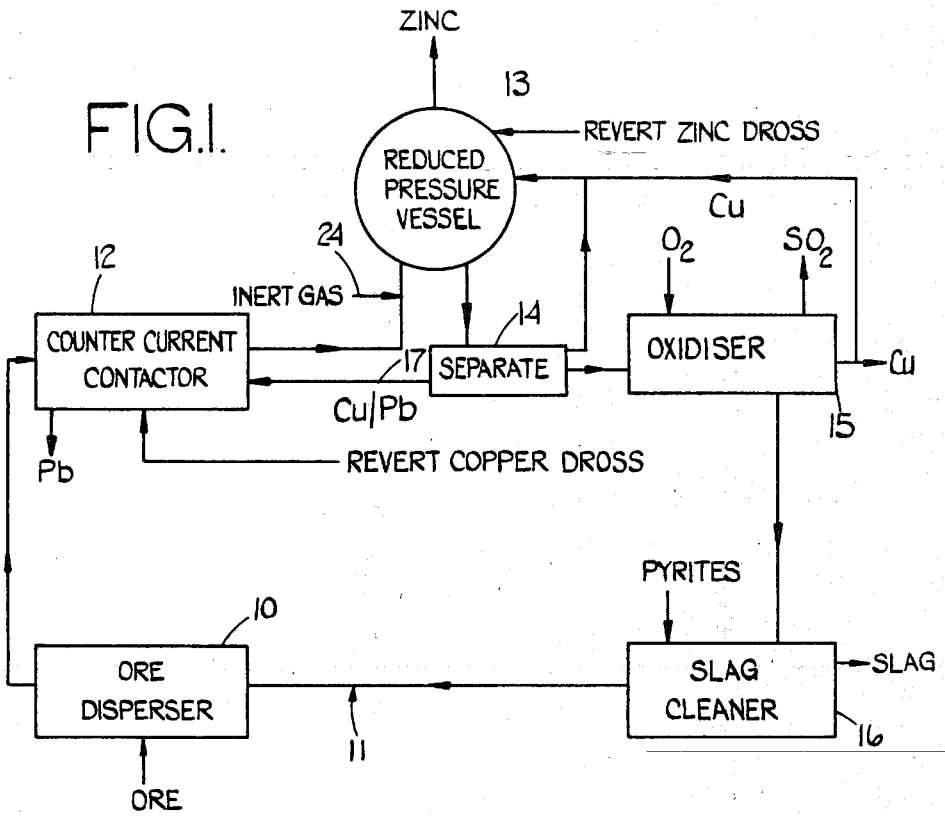
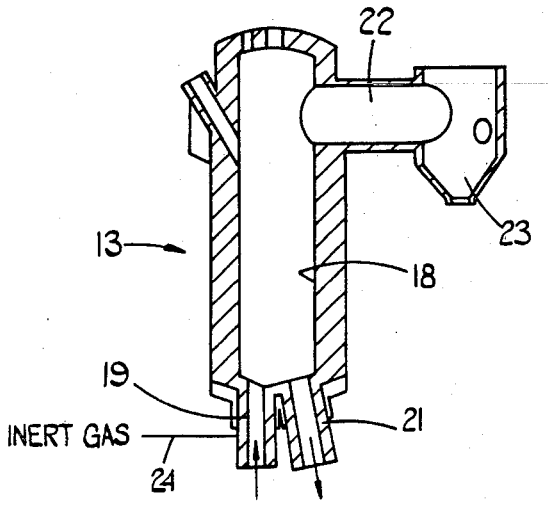
FIG.2.

METHOD OF RECOVERING NON-FERROUS METALS FROM THEIR SULPHIDE ORES

This invention relates to a method of recovering non-ferrous metals from their sulphide ores.

In its broadest aspect, the invention resides in a method of recovering a non-ferrous metal from a sulphide ore of the metal using a metal extraction circuit from which said non-ferrous metal or its sulphide can be continuously extracted at an elevated temperature, the method comprising the steps of forcibly circulating a molten sulphide carrier composition through the extraction circuit, introducing the sulphide ore into the molten carrier composition at an ore receiving station so that the ore is dissolved in or melted by the composition, and contacting the molten carrier composition containing said ore with oxygen at an oxidation station so as to oxidize at least part of the ore and/or the molten carrier composition, heat generated during the oxidation step being recovered by the molten carrier composition and being transmitted thereby to endothermic sites in the circuit.

In the method described in the preceding paragraph, the circulating molten sulphide carrier composition not only serves to transport the ore between the various processing stations, but also serves to recover the heat generated during the oxidation step (which will necessarily be exothermic) and transfer this heat to endothermic sites. In this way, the energy input required to achieve continuous extraction of the non-ferrous metal or its sulphide can be dispensed with or reduced.

In a further aspect the invention resides in a method of recovering a non-ferrous metal from a sulphide ore of the metal using a metal extraction circuit from which said non-ferrous metal can be continuously extracted, the method comprising the steps of forcibly circulating a molten sulphide carrier composition through the circuit, introducing the sulphide ore into the circulating molten carrier composition at an ore receiving station so that the ore is dissolved in or melted by the composition, and contacting the molten carrier composition containing said ore with oxygen at an oxidation station so that (a) the sulphide ore is converted to the non-ferrous metal to be extracted, or (b) a further sulphide in said composition or said ore is converted to a material capable, directly or after further processing, of reducing said sulphide ore to produce said non-ferrous metal to be extracted, and subsequently removing said non-ferrous metal, heat generated during the oxidation step being recovered by the molten carrier composition and being transmitted thereby to endothermic sites in the circuit.

Preferably, the extraction circuit includes a reduced pressure vessel where a volatile material in the form of said metal or sulphide to be extracted or a volatile impurity is removed by suction.

Preferably, the ore is reduced in said vessel to produce said metal to be extracted or said volatile impurity.

Preferably, the suction provides at least part of the motive force required to circulate said molten sulphide composition.

Preferably, said molten composition is caused to circulate by injecting a gas into said composition at said reduced pressure vessel so as to produce a localised decrease in the density of the composition and thereby allow the suction to draw the composition into said vessel.

Preferably, said circuit includes a slag removing station where surface slag on the composition can be removed.

Preferably, the slag is cleaned prior to removal, conveniently in addition to the slag of a chemical reducing agent, preferably a carbonaceous material, and/or iron pyrites or the ore itself.

Preferably, where the metal to be extracted is zinc, the molten sulphide composition contains copper sulphide and the oxidation converts the copper sulphide to copper which then defines said material capable of directly reducing the zinc sulphide ore to zinc.

Alternatively, where the metal to be extracted is zinc, the circulating molten composition contains iron sulphide and the oxidation converts the iron sulphide to iron oxide which defines said material capable, after further processing, of reducing the zinc sulphide ore to zinc, the further processing of the iron oxide including reducing the iron oxide to metallic iron, preferably with a carbonaceous material.

Alterntively, the metal to be extracted is copper or nickel and the oxidation converts the copper or nickel sulphide ore to the required copper or nickel.

Alternataively, said ore is a tin sulphide ore and tin sulphide is removed as the volatile material in the reduced pressure vessel.

Preferably, said oxidation station includes means located above the circulating composition for directing a jet of air, oxygen, or oxygen-enriched air onto the composition.

Figure 4:
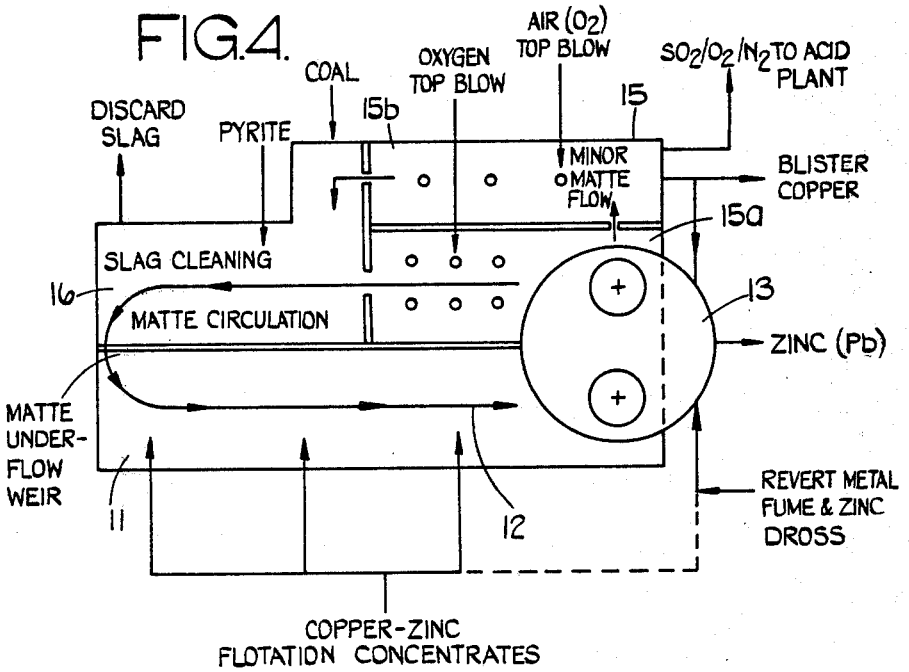
Figure 5:
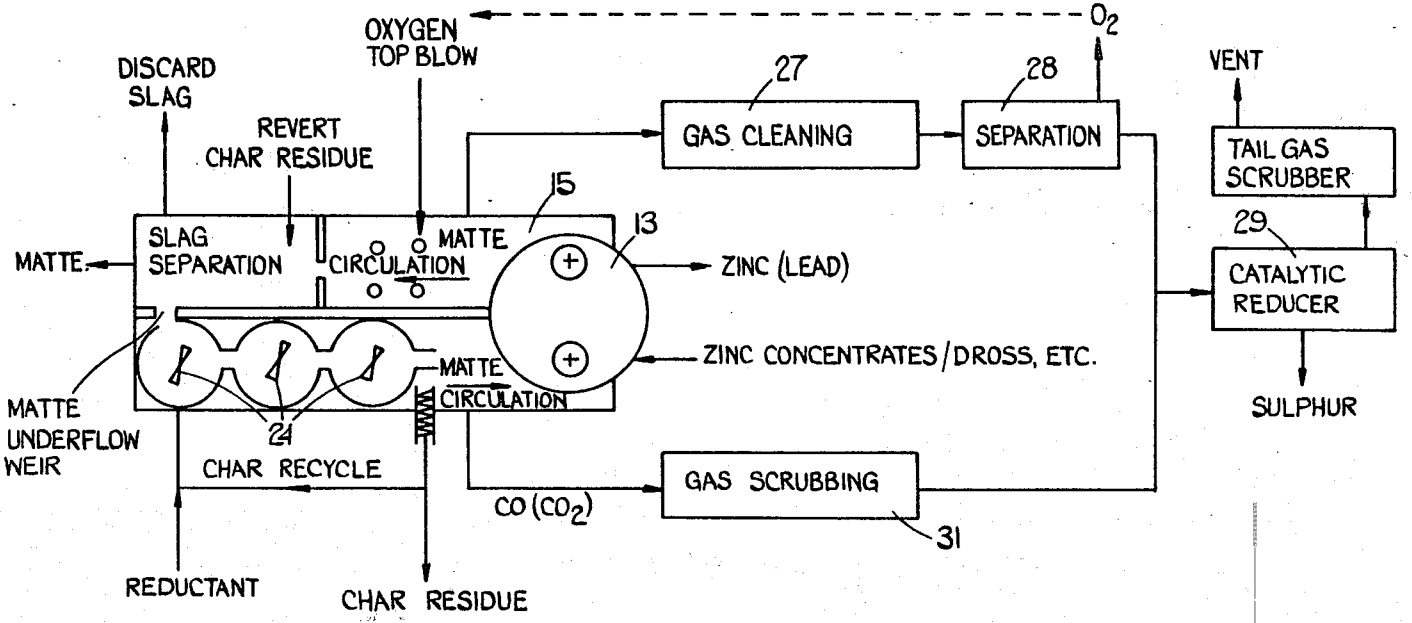

In the accompanying drawings:

FIG. 1 is a block diagram illustrating a method of recovering zinc according to one example of the invention, FIG. 2 is a diagrammatic illustration of the reduced pressure vessel used in the method of said one example, and FIGS. 3 to 5 are plan view illustrating diagrammatically respective modifications of said one example.

Referring to FIGS. 1 and 2, in the method of said one example zinc is extracted from a concentrated lead/zinc/copper sulphide ore, one readily available example of such an ore concentrate containing 49.2% lead, 7.6% zinc, 4.5% copper, 13.4% iron and 22.9% sulphur, all by weight. The ore concentrate is introduced in any convenient form into an ore dispersing unit 10 where it is melted by, and dissolved in, a continuously circulating stream 11 of a molten matte. The matte is an impure copper sulphide which is generally referred to as white metal and which normally contains less than 5% by weight of iron. Conveniently, the temperature of the molten matte in the unit 11 is of the order of 1150°–1350° C.

From the ore dispersing unit 10, the ore is carried by the molten matte to a counter current contactor 12 and then to a reduced pressure vessel 13, whereafter the molten matte passes by way of a separator 14 to an oxidising unit 15 and then a slag cleaner 16 before returning to the ore dispersing unit 10. In the example shown the components 10 and 12 to 16 are shown as separate interconnected processing units. In practice, however, it may be desirable to perform the entire method within a single furnace with the molten matte being directed by baffles between the various spaced processing stations.

In the counter current contactor 12, the stream 11 of molten matte and dissolved ore flows over a series of weirs of increasing height, while a stream 17 of molten copper (alloyed with a small quantity of lead) taken from the outflow of the vessel 13 flows in the opposite direction through the contactor 12. This counter current flow ensures effective contact between the streams 11, 17 so that the molten copper removes the majority of the lead from the dissolved ore by the following reaction:

$$2Cu + PbS = Pb + Cu_2S$$

In order to increase the efficiency of this reaction, it may be desirable to agitate the interface between the streams 11, 17 so as to increase the turbulence and the active surface area of contact at the interface. The molten metal phase in the contactor 12 collects between the weirs and, as the reaction proceeds, the lead content increases so that lead-rich alloy can be removed from the contactor 12 for purification, any copper removed with the molten alloy being returned to the contactor 12.

After leaving the contactor 12, the molten matte together with the lead depleted ore is lifted into the vessel 13 by a vacuum pump which provides the motive force necessary to circulate the molten matte. Also flowing into the vessel 13 is part of the molten copper which, as described below, is obtained from the separator 14 and the oxidising unit 15. The molten copper reacts with the zinc sulphide in the dissolved ore to produce metallic zinc according to the following reaction:

$$2Cu + ZnS = Cu_2S + Zn$$

The metallic zinc, which is volatile under the conditions existing in the vessel 13 is then withdrawn by the vacuum pump for collection in a suitable external condenser (not shown). Any impure zinc dross deposited in the condenser or elsewhere is recycled to the vessel 13.

As shown in FIG. 2, the vessel 13 is similar to the apparatus used in the RH steel de-gassing process and includes a cylindrical, vertically extending chamber 18 lined with refractory material and formed at its base with inlet and outlet legs 19, 21 respectively for the molten matte 12. At its upper end, above the level of the molten reaction mixture, the chamber 18 is connected by way of a conduit 22, a dust catcher 23, and a condenser (not shown) to the vacuum pump(s), conveniently one or more Roots pumps or a steam jet ejector system. A stream 24 of inert or active gas is directed into the inlet leg 19 of the chamber so as to produce a localised reduction in density of the molten matte 12 whereby the vacuum pump(s) raise the matte through the inlet leg 19 into the chamber 21. The turbulence thereby induced in the matte 12 flowing into the chamber 21 ensures intimate contact between the ore and the molten copper which is directed into the chamber 21 at any convenient point. Preferably the molten copper, after introduction into the chamber 21, is caused to form a series of attenuated streams or ligaments which increased surface area. Conveniently, a further inert gas stream could be introduced into the vessel to assist removal of the volatiles.

The molten material leaving the de-zincing vessel 13 flows initially to the separator 14, where the remaining molten copper together with any dissolved lead separates and is directed to the vessel 13 and, as the stream 17, to the counter current contactor 12. After separation of the copper, the molten matte passes to the oxidising unit 15 where oxygen is blown into the matte so as to oxidise the matte solution in accordance with the following reactions:

$$Cu_2S \xrightarrow{O_2} 2Cu + SO_2$$

$$FeS \xrightarrow{O_2} FeO/Fe_3O_4 + SO_2$$

The oxidation of the ferrous sulphide occurs preferentially and the iron oxides produced react with suitable flux additions to form slag on the surface of the molten matte. The molten copper is removed from the oxidising unit 15 and part is returned to the de-zincing vessel 13 for reducing the zinc sulphide, while the remainder is collected as blister copper. The blister copper is fed to an external furnace to adjust its sulphur and oxygen content before being electrolytically purified. The sulphur dioxide produced during oxidation of the copper sulphide can be converted to sulphuric acid or fixed as elemental sulphur in the manner described below.

Conveniently, oxygen is introduced into the oxidising unit 15 by way of a plurality of oxygen lances located above the molten matte, the forced circulation of the matte ensuring that any slag is removed from the vicinity of the lances so that adequate oxygen penetration of the matte is possible. It is, however, important to avoid excessive oxidation of the matte since any cuprous oxide produced will tend to dissolve in the slag and hence increase the difficulty of the subsequent slag cleaning operation. In order to control the oxidation, it may be advisable to provide a cellular arrangement of closely positioned oxygen lances so that the circulation patterns produced in the surface of the matte by impingement of the oxygen jets are reduced by interference with one another to limit oxygen dissolution and diffusion through the liquid matte.

After passage through the oxidising unit 15, the matte stream 11 overflows into the slag cleaner 16 which is located at a lower level than the unit 15. In the cleaner 16 iron pyrites is added to the slag to decrease the amount of dissolved copper in the slag and possibly to restore the sulphur balance of the matte. In addition, coal or another suitable chemical reductant may be added to the slag during the cleaning process so that any iron sulphide oxidized to magnetite in the oxidising unit 15 can be reduced to ferrous oxide so as to reduce the oxygen potential of the slag and hence lower the solubility of copper in the slag. After cleaning, the slag is removed while the molten matte is returned to the ore dispersing unit 10 to be recycled. However, before recycling it may be desirable to add further coal or other reductant to the matte, preferably with the matte being agitated, so as to convert cuprous oxide dissolved in the matte to metallic copper.

It will be appreciated that in the method described above, the oxidation occurring in the unit 15 is exothermic and hence raises the temperature of the molten matte, whereas the processes occurring in the slag cleaner 16, the ore dispersing unit 10 and most particularly in the de-zincing vessel 13 are endothermic and hence lower the temperature of the matte. The circulating matte, however, acts to recover the heat generated during the exothermic parts of the process and transfer this heat to sites of endothermic reaction. In this way, provided the mass flow rate of the circulating matte is considerably larger than the rate of input of ore, the energy input required to maintain the process can be minimised. The preferred ratio of circulating matte to dissolved ore will vary with the thermal requirements of the system concerned and the need on the one hand to maintain the matte above its liquidus temperature and the practical difficulties on the other hand of achieving acceptable refractory life at high temperatures. In general, however, with the production of zinc by the method described above the matte circulation rate is preferably 20–80 moles of matte for each mole of zinc contained in the ore concentrate.

Further it is to be understood that in practice the method described above is controlled so as to ensure that the composition of the matte at the end of each cycle is substantially constant despite the continuous addition of the ore and the recovery of zinc and other metals in the ore. If necessary, however, the matte could be replenished by the addition of extra matte, or a material containing copper sulphide or metallic copper.

As an alternative to the method described above, the ore concentrate could be added directly to the vessel 13, preferably in micro-pelletised form, in which case the ore dispersing unit 10 would be omitted. In view of the obvious complications involved in adding solids to an evacuated system, it is in general preferable to add the ore separately from the vessel 13. However, with ore concentrates which are difficult to disperse in the molten matte, the violent gas evolution and extreme turbulence existing in the vessel 13 would enhance the ore dispersal and could make it worthwhile accepting the additional complication necessary for the concentrates to be introduced into the vesel 13. Moreover, adding the ore concentrates directly to the vessel 13 may be desirable to increase chemical activity and thereby allow high rates of products extraction and harmful impurity elimination to be obtained.

Where the method described above is used to extract zinc from ores having a low iron content, maintaining the matte within the optimum operating temperature range may require the supply of external heat to the matte. This could be achieved by means of an oxy-fuel burner which would preferably be located between the de-zincing vessel 13 and the oxidising unit so as to contact the matte while substantially free of surface slag. A modification of the above example including an oxy-fuel burner 25 is shown in FIG. 3, in which the burner is used to raise the temperature of the molten matte before it enters the oxidising unit 15, the circulation of the matte preventing slag build-up around the burner. In this modification, the matte is again white metal whereas the ore is a Broken Hill high grade zinc concentrate containing 53.9% zinc, 32.2% sulphur, 0.6% lead, 8.75% iron and 1.7% silica, all by weight. With such a low lead content in the ore the need for a separate lead extraction stage, the counter current contactor 12 and separator 14 in FIG. 1, is avoided, the small quantities of lead in the ore being extracted with the zinc in the vessel 13. Moreover, an excess of the stoichiometric quantity of metallic copper required for extracting the zinc may be circulated between the vessel 13 and the oxidising unit 15. However, since the ore contains only trace amounts of copper, addition of a copper-containing material would be necessary to compensate for the inevitable copper losses from the matte.

The method described above employing a white metal matte can also be used to treat the well-known McArthur River bulk flotation concentrate which contains 29.2% zinc, 9.5% lead, 13.2% iron, 0.6% copper, 28.5% sulphur, and a total of 13.3% of silica and alumina, all by weight. Again the lead/zinc ratio is too small to involve separation of a separate lead phase before the vacuum de-zincing stage. Moreover, in this case the need for an external heat input by way of the oxy-fuel burner shown in FIG. 3 may be obviated if the ore concentrate is added as dry, micropellets directly to the vessel 13.

In a further modification of the above example, the matte is a copper sulphide/iron sulphide mixture containing 50–70% by weight of copper whereas the ore is a copper-zinc concentrate containing 25.6% copper, 10% zinc, 1.7% lead, 24% iron, and 33% sulphur, all by weight. Again the need for a separate lead extraction stage is avoided. However, as shown in FIG. 4, in this modified method, to avoid excessive loss of copper through dissolution of cuprous oxide in the large amount of slag produced, the oxidising unit 15 is divided into first and second parts **15*a*, 15*b* respectively. The major portion of the matte passes through the first part 15*a* and, as in the previous example, is oxidised by oxygen lances located above the matte stream. However, the oxidation in the part 15*a* is controlled so that only the preferential oxidation of the ferrous sulphide occurs, although of course this raises the temperature of the matte. The minor portion of the matte is directed through the second part 15*b* and is top blown with oxygen-enriched air so that both iron and copper sulphides are oxidised to produce a molten copper phase as well as a slag phase containing iron oxides and inevitably some dissolved cuprous oxide. The molten copper phase produced in the part 15*b* is separated so that part can be extracted as blister copper and the remainder fed back to the de-zincing vessel 13. After passing through the part 15*b*, the remaining matte and slag phases are remixed in a cascade fashion with the main matte stream in the slag cleaner 16, with coal conveniently being introduced into the remixing region so as to reduce the oxygen potential of the slag and hence decreases the solubility of the cuprous oxide in the slag. In addition, as described with reference to FIG. 1**, further slag cleaning is provided by the addition of iron pyrites to the slag.

Referring to FIG. 5, in yet a further modification of the above example, the matte employed is of a low grade in terms of its copper content and may even be composed principally of iron oxide and iron sulphide. As in the previous modification, the ore to be treated has a low lead content and hence a separate lead separation stage is unnecessary. Moreover, in view of the low copper content of the matte, the loss of copper during oxidation of the matte is no longer a problem and hence a single oxidising unit 15 is employed. However, oxidation of the matte will now proceed mainly in accordance with the following reaction:

$$2FeS+3O_2=2SO_2+2FeO$$

to produce ferrous oxide and hence it is necessary to reactivate the oxidised matte, conveniently with a carbon reducing agent such as coal or coal char. The reducing agent is conveniently added between the slag separation stage and the vessel 14, with agitators 26 conveniently being provided to ensure adequate mixing between the reducing agent and the matte stream. Reduction of the ferrous oxide produces metallic iron according to the following reaction:

$$FeO + C = Fe + CO$$

although, unlike the copper-rich matte employed previously, the metallic iron remains in solution in the matte. In addition, it will be noted that the gaseous products of the method of this further modification are carbon monoxide (together with some carbon dioxide) and sulphur dioxide (together with some residual oxygen). This provides the possibility of fixing the sulphur dioxide as elemental sulphur by catalytic reduction of the sulphur dioxide with the carbon monoxide. Thus the sulphur dioxide issuing from the oxidising unit 15 is passed through a cleaner 27 and an oxygen separator 28 to a catalytic reducer 29 which also receives the carbon monoxide after the latter has been passed through a scrubber 31 to remove the carbon dioxide.

Although the previous discussion has been restricted to zinc extraction, it is to be appreciated that the method described above could also be applied to the smelting of other non-ferrous metals from their sulphide ores. Thus, for example, blister copper could be extracted from a copper sulphide ore containing lead, antimony, arsenic and bismuth impurities. In this case the volatile impurities would be removed in the vessel 13 with the blister copper being obtained as an outflow from the oxidising unit 15. Nickel sulphide ores could be smelted in the same way as copper sulphide ores. Similarly, using a copper/nickel/cobalt sulphide concentrate, which would conveniently be introduced into the molten matte through the slag layer, the outflow from the oxidising unit 15 would be a copper/nickel/cobalt alloy which could then be cast into an anode material for electrorefining into its constituent elements. As a further alternative, the process of the invention could be used to recover tin from a complex tin sulphide ore, in which case the volatility of the tin sulphide would mean that most would be removed in the vessel 13 without undergoing chemical reduction.

I claim:

1. A method of recovering a non-ferrous metal from a sulphide ore containing the metal using a metal extraction circuit from which said non-ferrous metal can be continuously extracted at an elevated temperature, the method comprising the steps of forcibly circulating a molten sulphide carrier composition through the extraction circuit so that the carrier composition flows in turn through an ore receiving station, an oxidation station, and a slag removing station and back to the ore receiving station, introducing the ore into the molten carrier composition at the ore receiving station so that the ore is dissolved in or melted by the composition at said ore receiving station, thereafter contacting the molten carrier composition containing said ore with oxygen at said oxidation station so that at least part of the fluid mass defined by the ore and the carrier composition is oxidized to produce a molten slag at the surface of the fluid mass and a component selected from the group consisting of a non-ferrous metal, a material capable directly of reducing a component of the fluid mass to produce a non-ferrous metal, and a material capable after further processing of reducing a component of said fluid mass to produce a non-ferrous metal, heat generated during the oxidation step being recovered by the molten carrier composition and being transmitted thereby to endothermic sites in the circuit including said ore receiving station, removing at least said non-ferrous metal to be extracted, and removing said molten slag at the slag removing station.

2. A method as claimed in claim 1, wherein the extraction circuit includes a reduced pressure vessel which is located between the ore receiving station and the oxidation station, suction being applied to said reduced pressure vessel to remove from said fluid mass a volatile material selected from the elemental form of the non-ferrous metal to be extracted and a sulphide of said metal.

3. A method as claimed in claim 2, wherein the suction provides at least part of the motive force required to circulate said molten sulphide carrier composition.

4. A method as claimed in claim 3, wherein a gas is introduced into said molten sulphide carrier composition at said reduced pressure vessel so as to produce a localised decrease in the density of the carrier composition and thereby allow the suction to draw the carrier composition into said vessel.

5. A method as claimed in claim 2, wherein the ore is reduced in said vessel to produce said metal to be extracted.

6. A method as claimed in claim 2 or claim 5, wherein the metal to be extracted is zinc, the molten sulphide carrier composition contains copper sulphide and the oxidation converts the copper sulphide to copper which then defines said material capable of directly reducing the zinc sulphide ore to zinc.

7. A method as claimed in claim 2 or claim 5, wherein the metal to be extracted is zinc, the molten sulphide carrier composition contains iron sulphide and the oxidation converts the iron sulphide to iron oxide which defines said material capable, after further processing of reducing the zinc sulphide ore to zinc, the further processing of the iron oxide including reducing the iron oxide to metallic form.

8. A method as claimed in claim 1, wherein the metal to be extracted is copper or nickel and the oxidation converts the copper or nickel sulphide to the required copper or nickel.

9. A method as claimed in claim 7, wherein said sulphide ore contains tin and tin sulphide is removed as the volatile material in the reduced pressure vessel.

* * * * *